United States Patent [19]

Adey et al.

[11] Patent Number: 4,625,694

[45] Date of Patent: Dec. 2, 1986

[54] FUEL PUMPING APPARATUS

[75] Inventors: Anthony J. Adey, Sevenoaks; Dorian F. Mowbray, Burnham, both of England

[73] Assignee: Lucas Industries public limited company, Birmingham, England

[21] Appl. No.: 753,371

[22] Filed: Jul. 10, 1985

[30] Foreign Application Priority Data

Jul. 13, 1984 [GB] United Kingdom ..... 8417861

[51] Int. Cl.[4] ..... F02M 39/00

[52] U.S. Cl. ..... 123/450; 417/462; 417/253; 123/516

[58] Field of Search ..... 123/450, 458, 516; 417/252, 253, 462

[56] References Cited

U.S. PATENT DOCUMENTS 3,936,244 2/1976 Drori ..... 417/462
3,961,861 6/1976 Mowbray ..... 417/253
4,310,291 1/1982 Green ..... 417/462
4,428,346 1/1984 Hoshi ..... 417/462

FOREIGN PATENT DOCUMENTS 850353 10/1960 United Kingdom ..... 417/253

*Primary Examiner*—Carl Stuart Miller

[57] ABSTRACT

A fuel pumping apparatus for supplying fuel to a compression ignition engine includes a positively reciprocated plunger which during a pumping stroke displaces fuel from a first pump chamber to an outlet and draws fuel into a second pump chamber. The apparatus includes an inlet chamber from which fuel is supplied to the second pump chamber, and a diaphragm pump which draws fuel into the inlet chamber through a fuel inlet. The pump drive shaft extends through the inlet chamber and carries vortex creating means whereby air entering the inlet chamber will collect around the shaft to cause early starvation of fuel supply to the associated engine in the event substantial quantities of air enter through said inlet.

7 Claims, 1 Drawing Figure

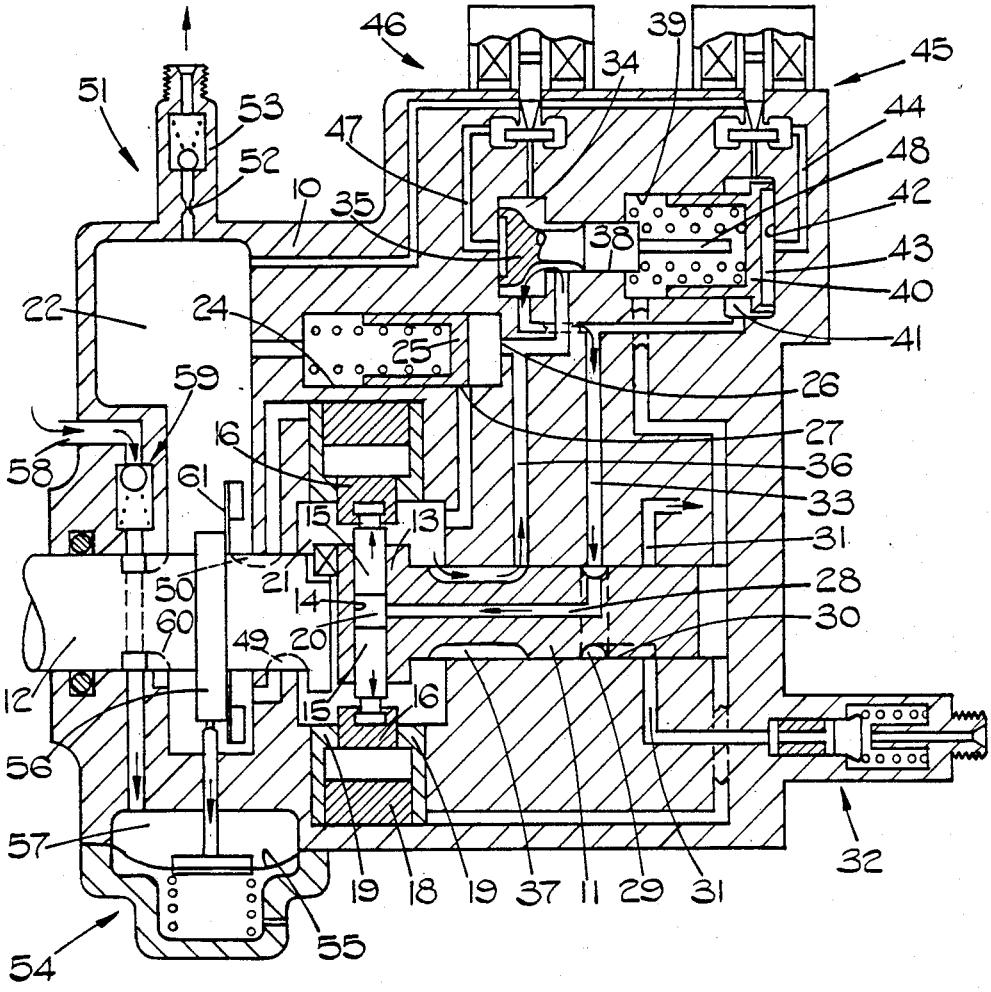
46
39
34
45
51
53
47
44
52
48
10
35
42
38
43
40
22
24
41
25
26
59
27
16
36
58
61
33
15
13
31
21
28
50
14
30
60
49
20
12
16
15
56
57
32
19
18
19
37
11
29
31
55
54

FUEL PUMPING APPARATUS

This invention relates to a fuel pumping apparatus for supplying fuel to a compression ignition engine, the apparatus including a high pressure pump having outlets for connection respectively to the injection nozzles of the engine.

A known form of pumping apparatus is of the rotary distributor type and is usually provided with a low pressure pump to supply fuel to the high pressure pump, the low pressure pump being of the vane or gear type coupled to the drive shaft of the apparatus. Such an apparatus if the associated fuel supply tank is allowed to run dry will not prime itself without extensive cranking of the engine. It has been the practice therefore to provide a further low pressure pump usually of the diaphragm type to supply fuel to the fuel inlet of the apparatus. Such a pump can have a large displacement with the result that the necessary priming of the apparatus and the purging of the fuel system of air can be achieved relatively quickly with the minimum of stress to the electrical system and starting motor of the engine. The provision of the diaphragm pump which is mounted on the engine, adds to the cost of the fuel system. Where the engine is for driving a long distance lorry the additional cost can be accommodated but where the engine is for driving a delivery van or small lorry, the additional cost is a serious disadvantage. It is much more likely, however, that such a vehicle will in its operating life run out of fuel because the attitude will often be taken by operators that there will be sufficient fuel in the fuel tank to enable a short journey to be undertaken.

By suitable design it is possible to use the high pressure pumping plungers of the distributor pump to draw fuel from the fuel tank but the rate at which the fuel can be pumped is limited by the fact that the maximum displacement of the plungers is often not much more than the maximum amount of fuel which can be displaced to the engine. The priming and purging of the fuel system can therefore require extensive cranking of the engine.

The object of the present invention is to provide such an apparatus in a simple and convenient form.

According to the invention a fuel pumping apparatus of the kind specified comprises a housing, a rotary distributor member mounted in the housing, a drive shaft coupled to the distributor member, said drive shaft extending to exterior of the housing and passing through a fuel inlet chamber defined in the housing, a plunger mounted within a bore formed in the distributor member, cam means for positively reciprocating the plunger in the bore in timed relationship with the associated engine in use, said plunger defining with said bore a first pump chamber, first passage means in the distributor member and housing for conveying fuel displaced from said first pump chamber to outlet ports in turn, said outlet ports in use being connected to the injection nozzles of the associated engine respectively, a second pump chamber in part defined by said plunger, the volume of said second pump chamber increasing as the volume of the first pump chamber decreases and vice versa, second passage means in the distributor member and housing through which fuel displaced from said second pump chamber can flow to said first pump chamber, third valve means for connecting said fuel inlet chamber with said second pump chamber while the volume of the second chamber is increasing, a diaphragm pump mounted on the housing, the diaphragm pump including a chamber in part defined by a diaphragm, a spring loading the diaphragm to reduce the volume of the chamber, a cam carried on said drive shaft for urging the diaphragm against the action of the spring said cam being arranged to allow movement of the diaphragm by the spring during the time the volume of said second pump chamber is increasing, and fourth valve means operable to connect the chamber of the diaphragm pump with a fuel inlet during movement of the diaphragm by the cam and with said inlet chamber during movement of the diaphragm by the spring.

An example of an apparatus in accordance with the invention will now be described with reference to the accompanying drawing.

Referring to the drawing the apparatus comprises a body part 10 in which is mounted a rotary distributor member 11 which is coupled to a drive shaft 12 which projects from the body part 10 and which in use is adapted to be coupled to a rotary part of the associated engine so that the distributor member rotates in timed relationship with the engine.

The distributor member has an enlarged portion 13 in which is formed a transversely extending bore 14, the bore mounting a pair of pumping plungers 15 which are positively connected to cam followers 16, each cam follower including a shoe captively mounting a roller.

Surrounding the enlarged portion of the distributor member is an annular cam ring 18 which on its internal peripheral surface, has in the particular example, four equiangularly spaced cam lobes which impart inward movement to the plungers 15, such inward movement being referred to as movement in the pumping direction. In addition, there is mounted in the body on opposite sides of the cam followers respectively, a further pair of cam rings 19 which define cam surfaces presented to the rollers, the cam surfaces being complementary to the internal surface of the cam ring 18. The surfaces on the cam rings 19 impart outward movement to the cam followers and pumping plungers, such outward movement being referred to as movement in the filling direction. It will of course be appreciated that there are as many cam lobes as there are cylinders of the associated engine.

Intermediate the plungers there is defined a so-called first pump chamber 20 and a second pump chamber 21 is formed by a space defined in the body part and into which the outer ends of the plungers 15 extend. It will be appreciated that as the plungers 15 are moved inwardly the volume of the chamber 20 decreases and the volume of the chamber 21 increases by the same amount.

The chamber 21 is arranged to communicate with a fuel inlet chamber 22 formed in the body part during inward movement of the plungers as will be explained.

Also provided is an accumulator and this comprises a chamber 24 formed in the body part and in which is slidable a spring loaded piston 25 which is biased towards the inlet opening 26 of the accumulator. Moreover, in the side wall of the chamber is formed a relief port 27 through which surplus fuel which has flowed through the inlet opening 26 can flow to the chamber 21 when the piston 25 has moved a predetermined extent against the action of its spring.

The pump chamber 14 communicates by way of a longitudinal passage 28 in the distributor member, with a circumferential groove 29 on the periphery of the distributor member. Extending from this groove is a groove 30 positioned to register in turn during inward movement of the plungers 15, with a plurality of outlet passages 31 which extend to the exterior of the housing and which as shown in relation to one of the passages may incorporate delivery valves 32 of conventional construction. The groove 30 and outlets 31 form a so-called first valve means. The outlets are connected in use to the injection nozzles of the associated engine and it will therefore be appreciated that there are as many outlets 31 as there are combustion chambers of the associated engine.

The groove 29 is in constant communication by way of a passage 33, with a valve chamber 34 formed in the body part and in which there is located the head of a controllable spill valve 35. The head of the spill valve is movable into contact with a seating, the valve being shown in the open position in the drawing. Beneath the seating there extends from the valve chamber 34 a passage 36 which opens onto the periphery of the distributor member. The passage 36 is connected to the inlet 26 of the accumulator and formed on the distributor member are, in the particular example, four longitudinally extending grooves 37 which are in constant communication with the chamber 21 but which connect with the passage 36 in turn during outward movement of the plungers 15. The grooves 37 and passage 36 form a so-called second valve means.

The valve member of the spill valve 35 is guided for movement in a bore 38 which opens into a cylindrical chamber 39 of enlarged diameter. Slidable in this chamber but spring biased away from the valve member is the skirt of a cup-shaped piston 40. The chamber 39 has an enlarged portion 41 which is in communication with the passage 33. Formed in the base of the piston presented to the end wall 42 of the enlarged portion 41, is a recess 43 and opening onto the aforesaid end wall is a passage 44. A solenoid operable valve 45 can control the communication between the passage 44 and the enlarged portion 41 of the chamber. In the closed position of the valve 45 the passage 44 has restricted communication with the inlet chamber 22. A similar valve 46 controls the communication between the valve chamber 34 and a passage 47 which opens onto the end wall of the valve chamber 34 and in similar manner the valve head of the spill valve is provided with a recess. In addition, the valve member of the spill valve has an extension 48 about which the springs of the piston 40 are located, which can be engaged as will be explained, by the piston 40 during its movement against the action of the springs. It should be noted that a spring is provided between the piston 40 and the valve member of the spill valve and a further spring between the piston and the annular end wall of the chamber 39.

The aforesaid second chamber 21 can be brought into communication with the inlet chamber 22 during movement of the plungers 15 in the pumping direction i.e. inwardly, by way of a so-called third valve means including a first set of longitudinal grooves 49 which are formed on the periphery of the drive shaft 12.

The grooves 49 establish communication between the lower portion of the inlet chamber 22 in the vicinity of the drive shaft and the lower portion of the chamber 21 whilst further longitudinal grooves 50 in the drive shaft also forming part of the third valve means, can establish communication between the chamber 22 at a higher position in the vicinity of the drive shaft, with the upper portion of the chamber 21.

The upper portion of the inlet chamber 22 has a drain outlet 51 which incorporates a restricted orifice 52 and a non-return valve 53. Fuel is delivered to the inlet chamber 22 by means of a diaphragm pump mounted on the body and generally indicated at 54, the diaphragm 55 being actuated by a cam 56 on the drive shaft. The diaphragm is spring loaded and the pump chamber 57 of the diaphragm pump is connected to a fuel inlet 58 by way of a non-return valve 59. The chamber 57 of the pump is connected to the inlet chamber 22 by an inlet valve arrangement which includes grooves 60 on the drive shaft.

The operation of the apparatus will now be described. In the drawing the direction of the arrows assume that the chamber 20 is being filled with fuel and therefore the plungers 15 are being moved outwardly and a groove 37 is in communication with the passage 36 and the groove 30 is out of register with an outlet 31. Moreover, the grooves 49 and 50 are positioned such that there is no communication between the chamber 22 and the chamber 21. During outward movement of the plungers fuel is displaced from the chamber 21 and flows by way of a groove 37, the passage 36, the open spill valve 35 and the passage 33 to the circumferential groove 29 and by way of the passage 28, to the chamber 20. Fuel in effect therefore is being transferred between the opposite ends of the plungers. The chamber 20 at the end of the outward movement of the plungers is completely full of fuel. As the drive shaft and distributor member continue to rotate the groove 37 will move out of register with the passage 36 and the groove 30 will move into register with an outlet 31. As the plungers start to move inwardly fuel will be displaced from the chamber 20 and will flow along the passage 28 to the circumferential groove 29. The fuel could flow along the groove 30 to an outlet 31 but such flow will not take place if the spill valve 35 is open as shown in the drawing. In this event the fuel flows by way of the passage 33 to the valve chamber 34 and from the chamber to the inlet 26 of the accumulator thereby displacing the piston 25.

When delivery of fuel is required the spill valve 35 is closed, the mechanism for achieving this being described later. With the closure of the spill valve fuel must now flow along the groove 30 to the selected one of the outlets 31 and hence fuel will be supplied to the associated engine. The quantity of fuel which flows to the engine depends upon the length of time, in terms of degrees of rotation of the distributor member, the spill valve is closed and the timing of the start of delivery of fuel depends upon the instant of closure of the spill valve. In order to terminate flow of fuel the piston member 40 is allowed to move away from the end wall 42 and the way in which this is achieved will be described later. As the piston member moves away from the wall its full end surface will be exposed to the high pressure and it will move rapidly thereby causing a reduction in the pressure and closure of the delivery valve 32. At the same time it will engage the extension 48 of the spill valve and will move the spill valve member to the open position. The spillage of fuel therefore takes place mainly to the accumulator although some fuel will be stored by the movement of the piston 40. Once the spill valve is opened the piston 40 due to the action of its springs, will be returned to the position in which it is shown i.e. in contact with the end wall 42, the displaced fuel flowing to the accumulator. The remaining volume of fuel displaced by the inward movement of the plungers 15 will be stored in the accumulator.

During inward movement of the plungers 15 the grooves 49 and 50 will place the chamber 21 in communication with the chamber 22 and since the volume of the chamber 21 decreases as the plungers are moved inwardly, fuel will be drawn into the chamber 21 from the chamber 22, thereby completely filling the chamber 21. In the event that the accumulator piston uncovers the port 27, spilled fuel will also flow into the chamber 21 and may displace fuel back into the chamber 22. The cycle is then repeated, the accumulator serving to assist the filling of the chamber 20 as soon as the plungers 15 can move outwardly it being appreciated that the spill valve 35 remains in the open position. During inward movement of the plungers 15 the cam 56 allows the diaphragm 55 to move under the action of its spring and fuel is therefore displaced from the chamber 57 into the chamber 22 by way of a groove 60 on the drive shaft.

It will be noted that the chamber 22 has an enlarged portion removed from the drive shaft. The drive shaft or cam 56 mounts a paddle arrangement indicated at 61 and the effect of this paddle arrangement during normal operation is to cause a vortex within the lower portion of the chamber 22 so that air accumulates around the drive shaft. Normally, the volume of air which is accumulated will be insufficient to enter the chamber 21 but in the event that air is drawn in through the inlet 58 due to a shortage of fuel in the supply tank, the volume of air in the vortex increases to the point that air starts to be drawn into the chamber 21 and from the chamber 21 the air will be supplied along with fuel, to the associated engine. This will cause the engine to lose power and eventually the quantity of fuel will be insufficient to maintain the operation of the engine. The engine will therefore stop and the fuel in the chamber 22 will fall to the lower portion of the chamber and the air will rise therein. Once the fuel tank has been recharged with fuel the operator can start the engine using the quantity of fuel which remains in the lower portion of the chamber 22 and at low speeds such as experienced during cranking, the paddle arrangement will be unable to create the vortex. The diaphragm pump will deliver into the chamber 22 a substantial quantity of air and fuel, the air travelling to the upper portion of the chamber 22 and being expelled to the drain or fuel tank, by way of the drain outlet 51. The grooves 50 i.e. those which place the upper portion of the chamber 21 in communication with the chamber 22 assist the purging of air from the chamber 21 at low speed operation of the apparatus by allowing the fuel levels in the chambers 21 and 22 to equalize during the time the grooves 49 and 50 connect the two chambers.

Turning now to the operation of the spill valve 35 and the piston 40. In the positions shown in the drawing, the head of the valve member of the spill valve head is in contact with the end wall of the chamber 34 and the piston in contact with the end wall 42. The valves 45 and 46 are energised and are therefore closed so that the passages 44 and 47 communicate with the inlet chamber 22. The pressure due to outward movement of the plungers 15 which when the spill valve is open, is determined by the accumulator, biases the valve member of the spill valve and the piston member into contact with the aforesaid end walls. In order to obtain delivery of fuel to the associated engine the valve 46 is de-energised and this connects the passage 47 directly with the chamber 34 so that the valve member of the spill valve is no longer pressure balanced to the open position and it moves rapidly to the closed position. The pressure in the chamber 34 and in the enlarged portion 41 therefore rises to the delivery pressure of the apparatus. When it is required to halt the delivery of fuel to the associated engine the valve 45 is de-energised and this places the recess 43 in the base wall of the piston, in communication with the chamber 41 so that the piston rapidly moves against the action of its springs and as previously described, causes movement of the spill valve member to the position shown in the drawing. With the reduction in pressure the piston member can return into contact with the end wall 42 and the valves 45 and 46 can be re-energised for the next cycle of operation.

We claim:

1. A fuel pumping apparatus for supplying fuel to a compression ignition engine comprising a housing, a rotary distributor member mounted in the housing, a drive shaft coupled to the distributor member, said drive shaft extending to the exterior of the housing and passing through a fuel inlet chamber defined in the housing, a plunger mounted within a bore formed in the distributor member, cam means for positively reciprocating the plunger in the bore in timed relationship with the associated engine in use, said plunger defining with said bore a first pump chamber, first passage means in the distributor member and housing for conveying fuel displaced from said first pump chamber to outlet ports in turn, said outlet ports in use being connected to the injection nozzles of the associated engine respectively, a second pump chamber in part defined by said plunger surrounding the distributor member, the volume of said second pump chamber increasing as the volume of the first pump chamber descreases and vice versa, second passage means in the distributor member and housing through which fuel displaced from said second pump chamber can flow to said first pump chamber, third valve means for connecting said fuel inlet chamber with said second pump chamber while the volume of the second chamber is increasing, said third valve means comprising channels in said drive shaft which establish communication between the lower portion of the inlet chamber in the vicinity of the drive shaft and the lower portion of the second pump chamber and between a higher position in the inlet chamber in the vicinity of the drive shaft and the upper portion of the second pump chamber, a diaphragm pump mounted on the housing, the diaphragm pump including a chamber in part defined by a diaphragm, a spring loading the diaphragm to reduce the volume of the chamber, a cam carried on said drive shaft for urging the diaphragm against the action of the spring, said cam being arranged to allow movement of the diaphragm by the spring during the time the volume of said second pump chamber is increasing, and fourth valve means operable to connect the chamber of the diaphragm pump with a fuel inlet during movement of the diaphragm by the cam and with said inlet chamber during movement of the diaphragm of the spring.

2. An apparatus according to claim 1, including a restricted drain outlet communicating with the upper portion of said inlet chamber through which air collecting in said inlet chamber can escape.

3. An apparatus according to claim 2, including a non-return valve in said drain outlet, said non-return valve acting to prevent flow of air or fuel into said chamber.

4. A fuel pumping apparatus for supplying fuel to a compression ignition engine comprising a housing, a rotary distributor member mounted in the housing, a drive shaft coupled to the distributor member, said drive shaft extending to exterior the of the housing and passing through a fuel inlet chamber defined in the housing, a plunger mounted within a bore formed in the distributor member, cam means for positively reciprocating the plunger in the bore in timed relationship with the associated engine in use, said plunger defining with said bore a first pump chamber, first passage means in the distributor member and housing for conveying fuel displaced from said first pump chamber to outlet ports in turn, said outlet ports in use being connected to the injection nozzles of the associated engine respectively, a second pump chamber in part defined by said plunger, the volume of said second pump chamber increasing as the volume of the first pump chamber decreases and vice versa, second passage means in the distributor member and housing through which fuel displaced from said second pump chamber can flow to said first pump chamber, third valve means for connecting said fuel inlet chamber with said second pump chamber while the volume of the second chamber is increasing, a diaphragm pump mounted on the housing, the diaphragm pump including a chamber in part defined by a diaphragm, a spring loading the diaphragm to reduce the volume of the chamber, a cam carried on said drive shaft for urging the diaphragm against the action of the spring, said cam being arranged to allow movement of the diaphragm by the spring during the time the volume of said second pump chamber is increasing, and fourth valve means operable to connect the chamber of the diaphragm pump with a fuel inlet during movement of the diaphragm by the cam and with said inlet chamber during movement of the diaphragm by the spring.

5. An apparatus according to claim 4 including a restricted drain outlet communicating with the upper portion of said inlet chamber through which air collecting in said inlet chamber can escape.

6. An apparatus according to claim 5 including a non-return valve in said drain outlet, said non-return valve acting to prevent flow of air or fuel into said chamber.

7. An apparatus according to any one of claims 1, 2 or 3 including vortex generating means in said inlet chamber, said vortex generating means being carried by the drive shaft whereby air collecting in the inlet chamber will accumulate around the drive shaft.

* * * * *